US006622443B2

(12) United States Patent
Votolato et al.

(10) Patent No.: US 6,622,443 B2
(45) **Date of Patent: *Sep. 23, 2003**

(54) TRIM FOR HIGH PRESSURE LAMINATE AND OTHER DECORATIVE FLOOR COVERINGS

(75) Inventors: Frank J. Votolato, Severn, MD (US); Victor A. Sainato, Sr., Pasadena, MD (US)

(73) Assignee: Interface, Inc., Atlanta, GA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/547,150

(22) Filed: Apr. 11, 2000

(65) Prior Publication Data

US 2001/0054264 A1 Dec. 27, 2001

Related U.S. Application Data

(60) Provisional application No. 60/135,716, filed on May 25, 1999.

(51) Int. Cl.[7] ..... E04F 15/024

(52) U.S. Cl. ..... 52/263; 52/470; 52/588.1; 52/716.8

(58) Field of Search ..... 52/800.1, 287.1, 52/391, 717.05, 272, 716.1, 717.06, 588.1, 470, 464, 263, 717.03, 717.8

(56) References Cited

U.S. PATENT DOCUMENTS

| | | | |
|---|---|---|---|
| 1,845,579 | A | 2/1932 | Borthwick |
| 2,717,187 | A | 9/1955 | Morgan et al. |
| 2,957,737 | A | 10/1960 | Irwin et al. |
| 3,150,748 | A | 9/1964 | Liskey, Jr. |

(List continued on next page.)

FOREIGN PATENT DOCUMENTS

| | | |
|---|---|---|
| AU | 605941 | 12/1987 |
| CA | 1017522 | 8/1975 |
| CH | 447568 | 11/1967 |
| CH | 452163 | 12/1968 |
| DK | 2102050 | 7/1972 |
| FR | 1601001 | 9/1970 |
| GB | 429301 | 2/1934 |
| GB | 876117 | 8/1961 |

OTHER PUBLICATIONS

Mult–a–Floor brochure identified in Sweet's Architectural Catalog File, 1967, McGraw Hill Information Systems Company, New York.

Product brochure of Liskey Elaflor Elevated Floor Systems, pp 16–32, publication date unknown, admitted to have been published prior to priority date of this application.

Drawing depicting the edge of a Maxcess Technologies, Inc. DuraTrim 2000 panel admitted to have been on sale in the U.S. as early as Feb. 1999.

Specification Sheet of Maxcess Technologies, Inc. DuraTrim 2000 panel edge treatment admitted to have been on sale in the U.S. as early as Feb. 1999.

*Primary Examiner*—Carl D. Friedman
*Assistant Examiner*—Jennifer I. Thissell
(74) *Attorney, Agent, or Firm*—John S. Pratt; Kristin L. Johnson; Kilpatrick Stockton LLP

(57) ABSTRACT

A plastic trim strip for use with high pressure plastic laminate (HPL) modules or other decorative modules used on access flooring. The strip is extruded polyvinyl chloride or other polymeric or other material such as decorative metals such as brass or aluminum. The cross sectional shape of the strip is generally rectangular with a rectangular tab that: (1) protrudes from one of the narrow edges of the rectangle, (2) is thinner than the height of the strip and (3) has one surface flush with the bottom of the strip. A portion of the edge of the HPL or other floor covering with which the strip is used, and having the same shape as the tab, is router or otherwise removed from the floor covering. The protruding tab of the trim strip is then "captured" within this rabbet with or without adhesive, thereby securely engaging the trim strip when the floor covering is installed on or bonded to the access flooring structure.

16 Claims, 1 Drawing Sheet

U.S. PATENT DOCUMENTS 3,548,559 A 12/1970 Levine
3,696,578 A 10/1972 Swensen et al.
3,703,431 A 11/1972 Kemper
3,913,292 A * 10/1975 Braekkan ..... 52/406.1
4,067,156 A 1/1978 Downing, Jr.
4,113,219 A 9/1978 Mieyal
4,142,341 A * 3/1979 Mott ..... 52/263
4,426,824 A 1/1984 Swensen
4,447,998 A * 5/1984 Griffin ..... 52/126.6
4,453,365 A 6/1984 Gladden
4,561,232 A 12/1985 Gladden, Jr. et al.
4,574,555 A * 3/1986 Cline ..... 52/783.1
4,625,491 A * 12/1986 Gibson ..... 52/791.1
4,671,832 A 6/1987 Cline
4,748,789 A 6/1988 Hedley
4,843,781 A 7/1989 Chase, III
4,850,176 A 7/1989 Munsey et al.
4,893,449 A * 1/1990 Kemper ..... 52/464
5,048,242 A 9/1991 Cline
5,111,630 A 5/1992 Munsey et al.
5,359,954 A * 11/1994 Kordelin ..... 114/85
5,551,201 A * 9/1996 Anderson ..... 52/717.05
5,653,075 A * 8/1997 Williamson ..... 52/309.9
6,077,576 A * 6/2000 Osborn ..... 428/31
6,134,851 A * 10/2000 Roze et al. ..... 52/204.597

* cited by examiner

TRIM FOR HIGH PRESSURE LAMINATE AND OTHER DECORATIVE FLOOR COVERINGS

CROSS-REFERENCE TO RELATED APPLICATIONS

This application claims priority to provisional patent application serial No. 60/135,716 filed May 25, 1999, which is incorporated herein by reference.

FIELD OF INVENTION

This invention relates to edge treatment for access flooring modules and other floor covering tiles and modules.

BACKGROUND OF INVENTION

Access flooring or raised panel flooring typically includes a structure resting on a concrete slab or original floor and supporting panels that form an elevated floor surface. These panels often incorporate or are covered by decorative materials such as carpet, carpet tiles, solid vinyl, or high pressure plastic laminate ("HPL"). When such materials are used, it is often desirable to surround modules of such materials with contrasting materials to provide a "trimmed edge" or grouted appearance. For instance, U.S. Pat. No. 4,625,491 for an "Elevated Floor Panel With Integral Trim" describes one such edging treatment. Another such edge treatment is disclosed in U.S. Pat. No. 4,574,555. These prior edge treatments do not, however, solve all of the problems associated with use of decorative surfaces for access floors.

SUMMARY OF THE INVENTION

The flooring trim of this invention is a plastic strip intended for use with high pressure plastic laminate (HPL) modules or other decorative modules used on access flooring. The strip may, for instance, be extruded polyvinyl chloride but could also be manufactured of a variety of other plastics and could be made from decorative metals such as brass or aluminum. The cross sectional shape of the strip is generally rectangular with a rectangular tab that: (1) protrudes from one of the narrow edges of the rectangle, (2) is thinner than the height of the strip and (3) has one surface flush with the bottom of the strip. A portion of the edge of the floor covering with which the strip is used, and having the same shape as the tab, is removed from the floor covering. For instance, a rectangular rabbet can be removed from the underside of, or formed in, the peripheral edge of the floor covering. The protruding tab of the trim strip is then "captured" within this rabbet, thereby securely engaging the trim strip when the floor covering is installed on or bonded to the access flooring structure. This mechanical engagement may be enhanced by utilizing adhesive.

Typically, the trim strips are sprayed with a water based contact adhesive before they are attached to the covered panels. Alternatively, such adhesive can be applied with a roller or pre-applied and initially protected with a release film. Solvent-based contact adhesive could be used in lieu of water borne adhesives, as could epoxy and cyanoacrylate adhesives. Additional, hot melt adhesive could be used.

The peripheral edge of the covered panel could be formed with the desired rabbet during manufacture of the covered panel, but it typically will be more practical to rout the underside of a full thickness floor covering panel in order to form the rabbet. A variety of thicknesses are possible, including HPL thicknesses of approximately 1/16th inch and 1/8th inch. Trim strips should be generally the same thickness as the floor covering. Trim joints at panel corners can be butt joints or mitered joints.

As will be appreciated by one skilled in the art, because the resulting flooring top surface is flat and smooth, without significant differences in level between the HPL panels and decorative edge treatment, dirt, dust and other debris will not be trapped at panel edges. Nevertheless, it may be desirable for the thickness of the trim to be slightly less than that of the adjacent panel in order to reduce wear on the trim.

The presence of the trim helps protects the floor covering edge from delamination and other degradation, particularly in response to loads applied during normal use. Because only the underside of a portion of the edge of the floor covering is removed, leaving the top decorative surface intact, there is reduced degradation of the floor covering and less damage to the wear surface and its performance characteristics than would otherwise be the case. The essentially flat surface that results from use of this trim with covered panels avoids depressions along the floor surface that can cause impact loads to result from rolling traffic over panel joints and edges.

The mechanical lock that result from having an edge of the floor covering overlie a portion of the trim strip and having adjacent trim strips abutting, together with use of adhesive, substantially enhances the physical integrity of the structure and prevents trim strips from falling off.

DETAILED DESCRIPTION OF THE DRAWINGS

Figure 1:
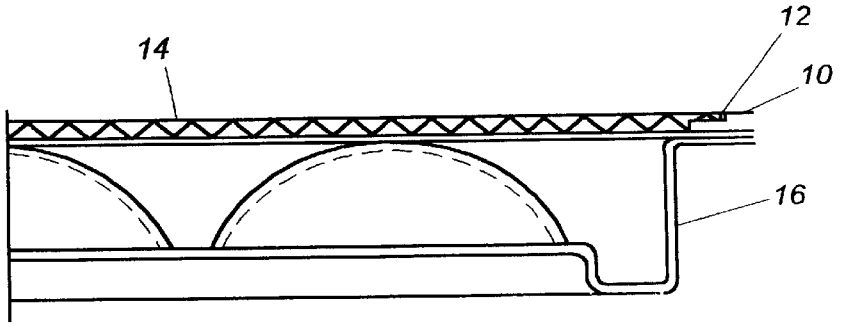
FIG. 1 is a side elevation view, in section, of an access flooring panel covered with a decorative module such as high pressure plastic laminate showing the trim strip of this invention in place.

FIG. 1 illustrates the trim strip 10 of this invention in place at the edge 12 of a HPL module 14. HPL module 14 could, alternatively, be any floor covering material such as solid vinyl or Conductile[1] brand or other brands of static-conductive tiles or modules. Trim strip 10 and HPL module 14 rest atop an access flooring panel 16. As may be more easily seen in the enlarged view of FIG. 2, a rabbet 18 has been formed at the edge 12 of HPL module 14, typically by routing or otherwise machining the edge 12. This rabbet 18 receives protruding rectangular tab 20 of trim strip 10. Tab 20 of trim strip 10 protrudes from a portion 22 of trim strip 10 having a generally rectangular cross section.

[1]Conductile brand static-conductive vinyl tile is available from Access Floor Systems, Inc., 20349 Highway 36, Covington, La. 70433.

Access flooring panel 16 may be a flooring module structural panel having a first generally planar sheet of metal 17 attached to a second sheet of metal 19 formed to provide support structure resisting deformation of the first sheet during use of the flooring module.

As is explained above, tab 20 is captured within rabbet 18 when trim strip 10 and module 14 are assembled on access panel 16. Adhesive maybe applied to the rabbet 18 and tab 20 in order to bond trim strip 10 to HPL module 14. Additionally, adhesive may be applied between the underside of both of trim strip 10 and module 14 and the top of access panel 16.

Figure 2:
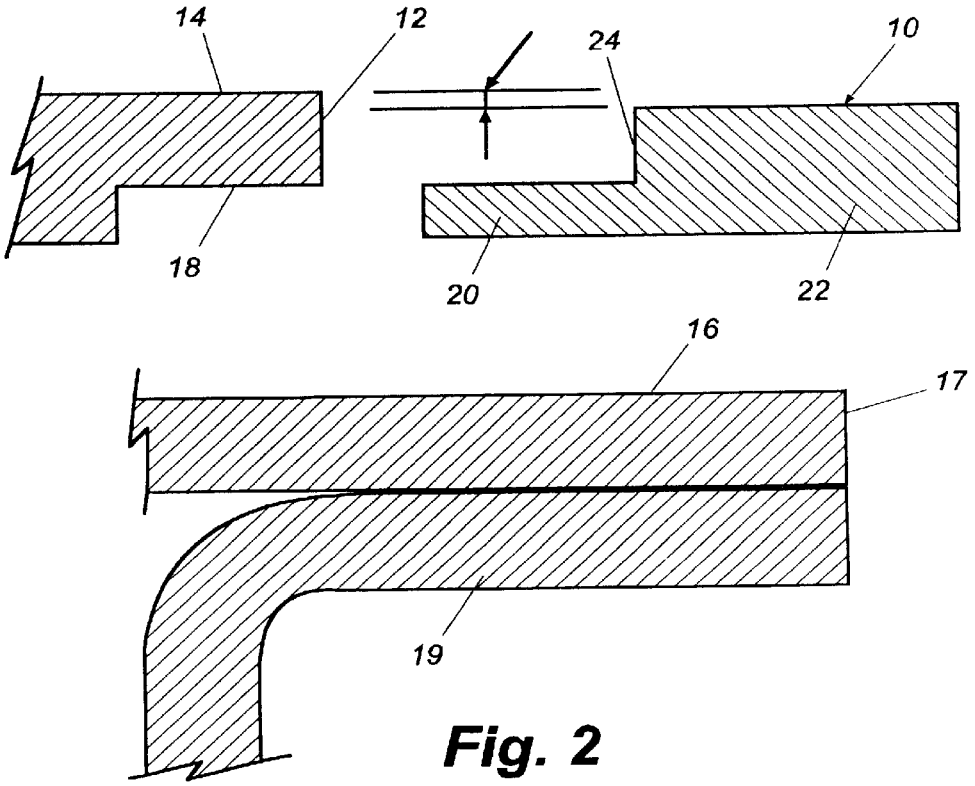
FIG. 2 is an enlarged, exploded, side elevation view, in section, of an edge of an access flooring panel with a high pressure plastic laminate module and the trim strip of this invention.

As is explained above, generally the thickness of the rectangular portion 22 of trim strip 10 will be approximately equal to and, preferable as is illustrated by dimension "x" shown in FIG. 2, slightly less than the thickness of HPL 14. For instance, each of rectangular portion 22 and HPL panel 14 might be 0.55 or 0.120 inches thick. The thickness of tab 20 and the depth of rabbet 18 will typically be approximately the same, although it may be desirable for tab 20 to be slightly thinner than rabbet 18 to accommodate adhesive between the two. For instance, the depth or thickness of rabbet 18 might be 0.030 inches while the thickness of tab 20 on trim strip 10 is 0.025 inches. These dimensions are, of course, merely exemplary. One skilled in the art will recognize that numerous other dimensions can be used.

The total width of trim strip 10 will be selected by reference to a variety of factors including, in particular, aesthetic considerations. This width may be, for instance, 0.31 inches, with the width of the tab 20 at 0.120 inches. Comparable dimensions for the width of rabbet 14 should also be selected, bearing in mind that the edge 12 of HPL module 14 will abut surface 24 of trim strip 10 if the length of tab 20 is less than the width of rabbet 18, which is desirable. Accordingly, the length of tab 20 should be slightly less than the width of rabbet 18. For instance, tab 20 could be 0.120 inches in length, and the width of rabbet 18 could be 0.125 inches.

What is claimed is:

1. Trim for flooring, comprising a strip of plastic material having a cross-sectional shape that is generally rectangular with a tab protruding from the rectangle, wherein the generally rectangular cross-sectional shape has two opposed sides and a top and a bottom, that are each wider than the sides, and the tab is generally rectangular, protrudes from one of the sides and has a bottom aligned with the rectangular bottom.

2. A flooring module, comprising:

(a) a generally rectangular sheet of plastic flooring material having a thickness and bounded by an edge having a rabbet in the edge, (b) a trim strip attached to the sheet of flooring material, the trim strip comprising a first portion of the trim strip occupying the rabbet and a second portion of the trim strip approximately equal in thickness to the thickness of the sheet and attached to the first portion.

3. The flooring module of claim 2, further comprising a metal plate underlying the sheet of plastic flooring material and the trim strip.

4. The flooring module of claim 3, wherein the metal plate has a peripheral edge adjacent to the trim strip.

5. The flooring module of claim 2, wherein the trim strip comprises polymeric material.

6. The flooring module of claim 5, wherein the polymeric material comprises polyvinyl chloride.

7. The flooring module of claim 2, wherein the sheet of plastic flooring material comprises high pressure plastic laminate.

8. The flooring module of claim 2, wherein the trim strip is attached to the sheet of plastic flooring material with adhesive.

9. The flooring module of claim 8, wherein the adhesive is a water based contact adhesive.

10. The flooring module of claim 2, wherein the thickness of the trim strip is slightly less than the thickness of the sheet of plastic flooring material.

11. A method for manufacturing a flooring panel module, comprising:

(a) manufacturing a sheet of plastic flooring material having an underside and a peripheral edge;

(b) routing a rabbet in the underside of the sheet of plastic flooring material adjacent to the peripheral edge;

(c) manufacturing a trim strip of polymeric material having a cross-sectional shape that is a rectangle attached to a tab having the same shape and approximately the same dimensions as the rabbet;

(d) applying adhesive to one or both of the trim strip and the sheet of plastic flooring material; and (e) attaching the trim strip to the sheet of plastic flooring material with the trim strip tab received in the rabbet and attaching the trim strip and sheet of flooring material to an upper surface of a flooring module structural panel to form a flooring panel having a decorative surface.

12. The method for manufacturing a flooring module of claim 11, wherein the trim strip comprises extruded polyvinyl chloride.

13. The method for manufacturing a flooring module of claim 11, wherein the sheet of plastic flooring material comprises high pressure plastic laminate.

14. The method for manufacturing a flooring module of claim 11, wherein the adhesive comprises a water-based contact adhesive.

15. The method for manufacturing a flooring module of claim 11, wherein the thickness of the sheet of plastic flooring is at least as thick as the thickness of the trim strip.

16. The method for manufacturing a flooring module of claim 11, wherein the flooring module structural panel comprises a first generally planar sheet of metal attached to a second sheet of metal formed to provide support structure resisting deformation of the first sheet during use of the flooring module.

* * * * *